United States Patent [19]

Webb, Jr.

[11] Patent Number: 4,559,683

[45] Date of Patent: Dec. 24, 1985

[54] BLIND TACKS FOR UPHOLSTERED FURNITURE

[75] Inventor: Kenneth L. Webb, Jr., Montoursville, Pa.

[73] Assignee: Schnadig Corporation, Chicago, Ill.

[21] Appl. No.: 332,474

[22] Filed: Dec. 21, 1981

[51] Int. Cl.[4] ..... B25H 1/04

[52] U.S. Cl. ..... 29/91.1

[58] Field of Search ..... 29/4, 5, 91.1, 91.2, 29/91.3, 91.5, 91.7, 91.8; 411/457-477

[56] References Cited

U.S. PATENT DOCUMENTS

| | | | |
|---|---|---|---|
| 24,242 | 5/1859 | Smith | 411/473 X |
| 628,380 | 7/1899 | Andrews | 411/457 |
| 2,005,669 | 6/1935 | Walters | 29/91.1 X |
| 2,066,814 | 1/1937 | Williams | 411/458 |
| 2,396,030 | 3/1946 | Terry | 411/458 X |

*Primary Examiner*—Howard N. Goldberg
*Assistant Examiner*—Timothy V. Eley

[57] ABSTRACT

A plurality of blind tacks are mounted on a stump panel or finishing panel for upholstered furniture. The tacks extend away from one of the panel surfaces, and the other panel surface is covered with fabric. The panel is attached by driving the tacks into the furniture.

4 Claims, 26 Drawing Figures

FIG. 5
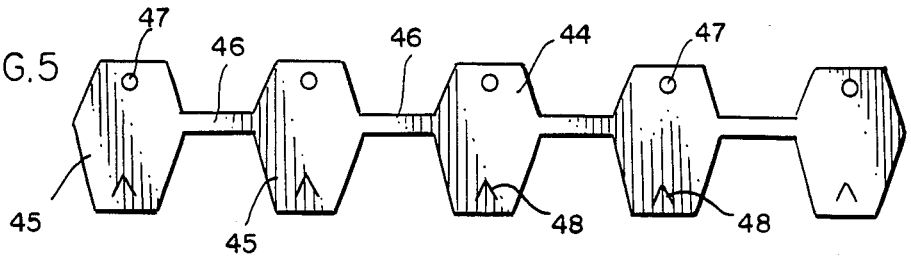
FIG. 6
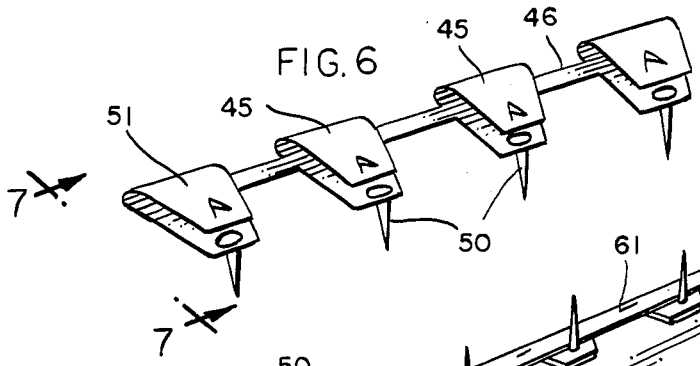
FIG. 7
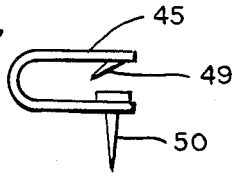
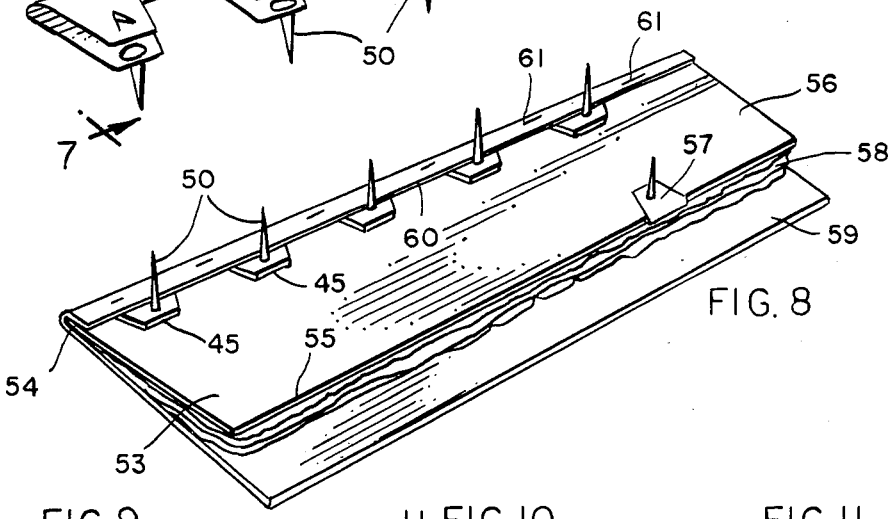
FIG. 8
FIG. 9
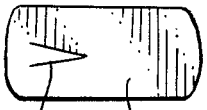
11 FIG. 10
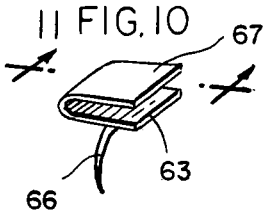
FIG. 11
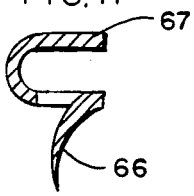
FIG. 12
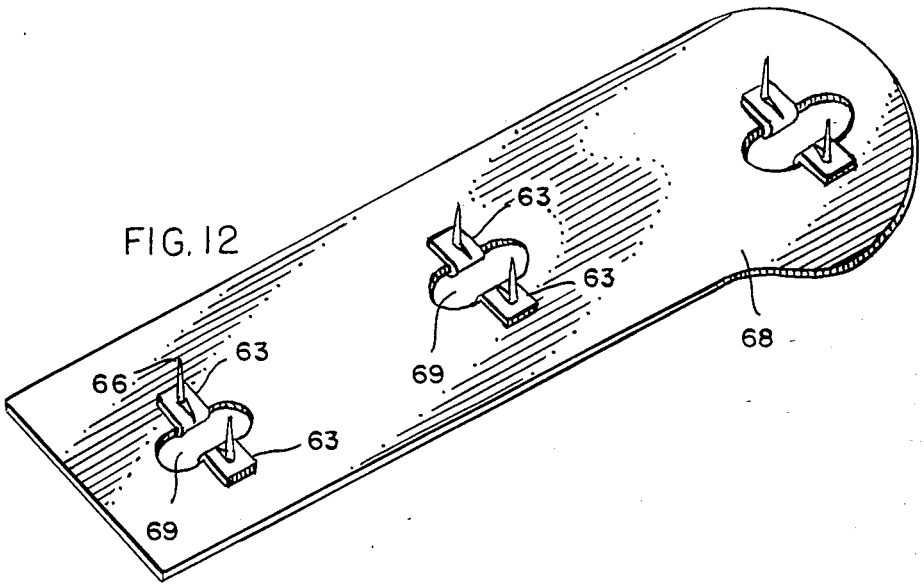

FIG. 13
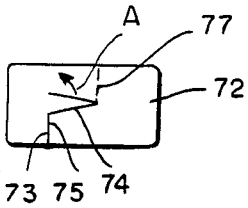
FIG. 14
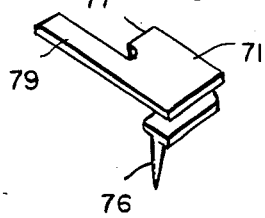
FIG. 16
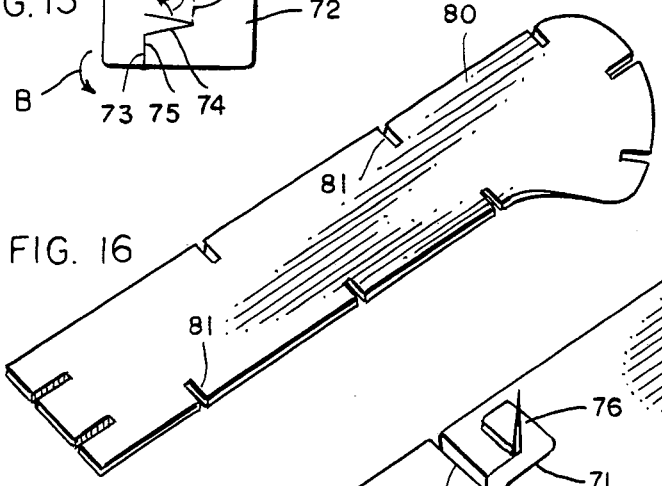
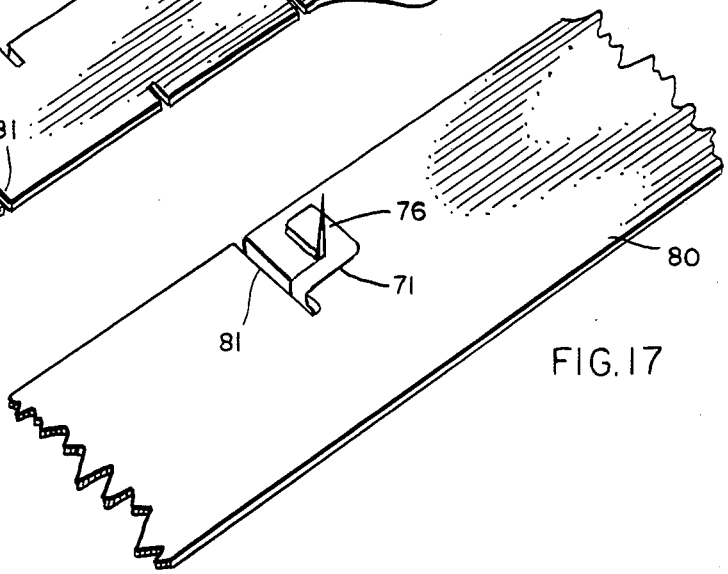
FIG. 17
FIG. 15
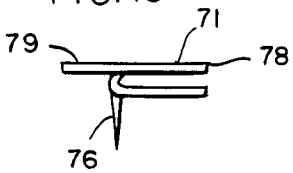
FIG. 18
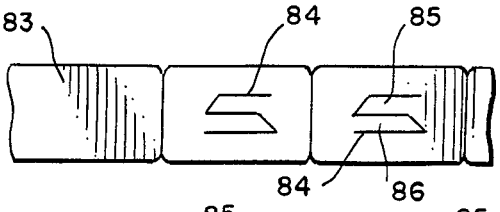
FIG. 20
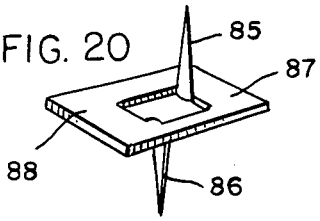
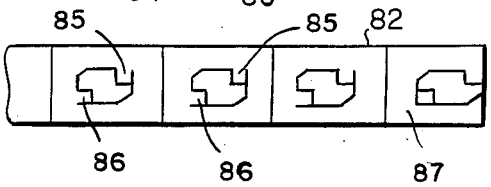
FIG. 19
FIG. 21
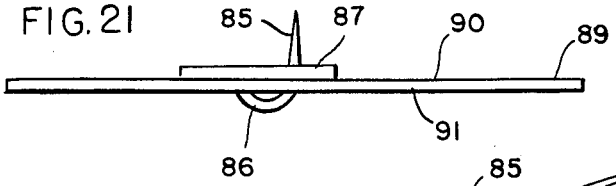
FIG. 22
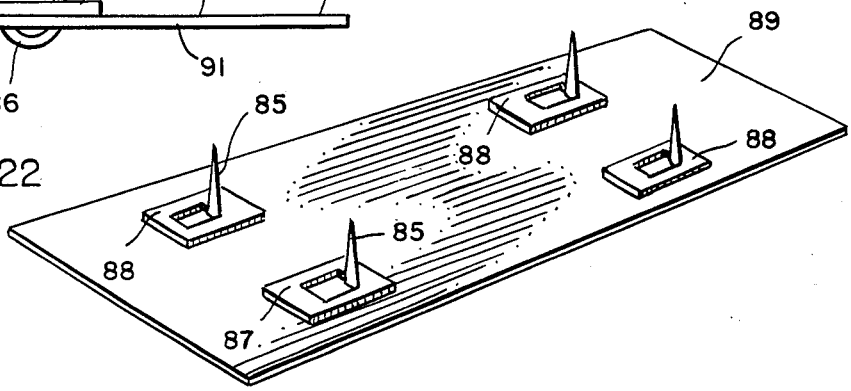

BLIND TACKS FOR UPHOLSTERED FURNITURE

BACKGROUND AND SUMMARY

This invention relates to blind tacts for upholstered furniture, and, more particularly, to blind tacks for attaching upholstered panels to upholstered furniture.

When furniture is being upholstered, there are often areas which require a stump panel or finishing panel in order to conceal seams, fabric edges, etc. For example, the arms of a sofa might have seams or edges where different pieces of fabric are brought together and attached to the arm. One conventional method of covering these seams or edges is to attach a fabric-covered panel to the arm by driving brads through the fabric and the panel into the arm. The small heads of the brads are then regulated, i.e., the fabric or the panel is pulled away from the heads so that the heads are concealed by the fabric.

This method of attaching finishing panels is not satisfactory for delicate fabrics. The delicate fabrics will be damaged by the brads and the regulating procedure.

The invention attaches finishing panels by using blind tacks, i.e., tacks which are not visible from the finished side of the panel. The blind tacks are mounted on the panel before the panel is covered with fabric, and the tacks are not driven through the fabric. The panel is attached to the furniture merely by hammering the fabric-covered surface of the panel to drive the tacks into the furniture.

DESCRIPTION OF THE DRAWING

The invention will be explained in conjunction with illustrative embodiments shown in the accompanying drawing, in which

FIG. 5 is a plan view of a strip of metal which is used for forming one type of blind tack;

FIG. 6 is a perspective view of a completed tack strip;

FIG. 7 is an end view of the tack strip taken along the line 7—7 of FIG. 6;

FIG. 8 is a perspective view of a partially completed finishing panel;

FIG. 9 is a plan view of a piece of metal for forming another blind tack;

FIG. 10 is a perspective view of the completed tack;

FIG. 11 is a sectional view taken along the line 11—11 of FIG. 10;

FIG. 12 is a perspective view of a finishing panel with a plurality of blind tacks mounted thereon;

FIG. 13 is a plan view of a piece of metal for forming another blind tack;

FIG. 14 is a perspective view of the completed tack;

FIG. 15 is a side elevational view of the tack of FIG. 14;

FIG. 16 is a perspective view of a finishing panel before the blind tacks and fabric are attached thereto;

FIG. 17 is an enlarged fragmentary perspective view showing one of the blind tacks mounted on the panel;

FIG. 18 is a plan view of a strip of metal in the process of being formed into tacks;

FIG. 19 is a plan view of the strip of FIG. 18 showing further processing steps;

FIG. 20 is a perspective view of a completed tack;

FIG. 21 is a side elevational view showing the tack of FIG. 20 mounted on a panel;

FIG. 22 is a perspective view showing a plurality of tacks of FIG. 20 mounted on a panel;

DESCRIPTION OF SPECIFIC EMBODIMENTS

Figure 1:
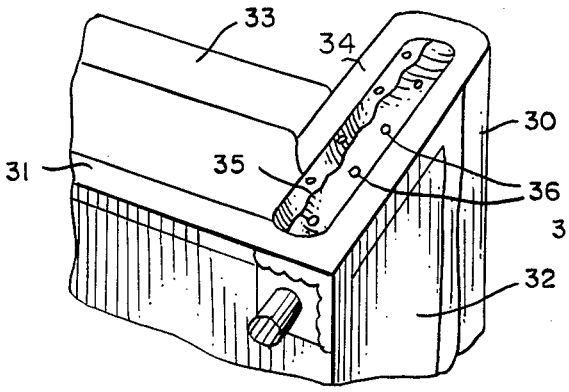
FIG. 1 is a fragmentary perspective view of the arm of an upholstered sofa before a finishing panel is attached.
Figure 2:
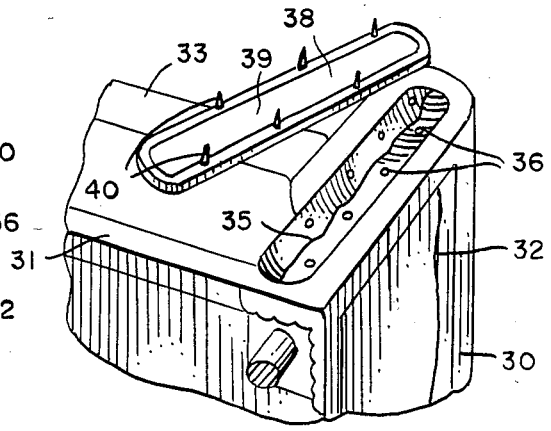
FIG. 2 is a view similar to FIG. 1 showing the finishing panel with tacks extending therefrom.

Referring to FIG. 1 and 2, an upholstered sofa 30 includes a base 31, an arm 32, and a seat cushion 33. The sofa is upholstered with fabric 34. The fabric pieces on both sides of the arm and on the front of the base are pulled and tacked along the front of the arm in a conventional manner. This procedure leaves the edges 35 of one or more fabric pieces and tacks or staples 36 visible on the front of the arm. The fabric edges may also have an unsightly pulled or gathered appearance as a result of the pulling and tacking step.

The fabric edges and tacks on the front of the arm are covered by a finishing panel or stump panel 38. The underside 39 of the panel is shown in FIG. 2, and a plurality of tacks 40 extend outwardly from the panel for attaching the panel to the sofa. The other side of the panel (shown in FIGS. 3 and 4) is covered with fabric 41, and the fabric can be pulled around to the underside of the panel and secured with tacks or staples. The fabric covers the tacks 40 on the outside of the panel, and the tacks are not visible on the outside of the panel. The panel is attached to the arm simply by hammering the outside of the panel with a mallet or hammer 42 (FIG. 3) to drive the tacks 40 into the arm.

FIGS. 5–8 illustrate one method of forming and attaching tacks to a panel. Referring first to FIG. 5, a metal strip 44 is stamped or punched to provide a plurality of flat bases 45 which are joined by connecting strips 46. A hole 47 is punched in one end of each base, and a V-shaped slit 48 is formed in the other end. The metal within the V-shaped slit is then pushed out of the plane of the strip to form a clinch 49 (see FIG. 7), a pointed nail or tack 50 is inserted into each of the holes 47, and the strip is bent along approximately the centerlines of the connecting strips 46 to provide the tack strip 51 shown in FIG. 6. The various steps of forming the tack strip can be performed at successive stations of a metal forming machine.

Referring now to FIG. 8, a flat panel 53 includes edges 54 and 55 and an undersurface 56. The bases 45 of the tack strip 51 are generally U-shaped, and the strip is mounted on the edge 54 by inserting the U-shaped bases over the edge so that the nail portions 50 extend generally perpendicularly to the undersurface 56. The U-shaped bases can then be squeezed together to force the clinches 49 into the panel.

Another tack strip 51 can be mounted on the edge 55 of the panel. Alternatively, the connecting strips 46 can be severed from each base 45 to form individual tacks 57, one of which is shown mounted on the edge 55.

Figure 3:
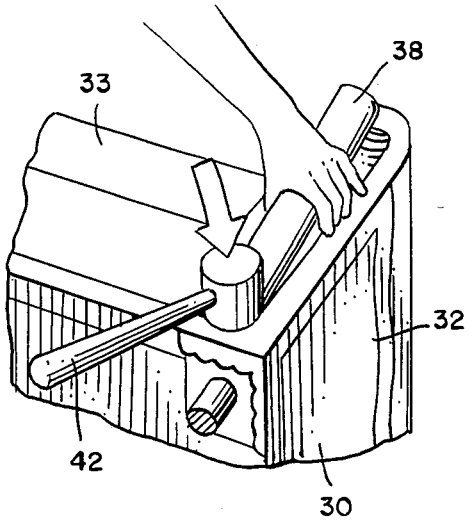
FIG. 3 illustrates the finishing panel being attached to the arm of the sofa.
Figure 4:
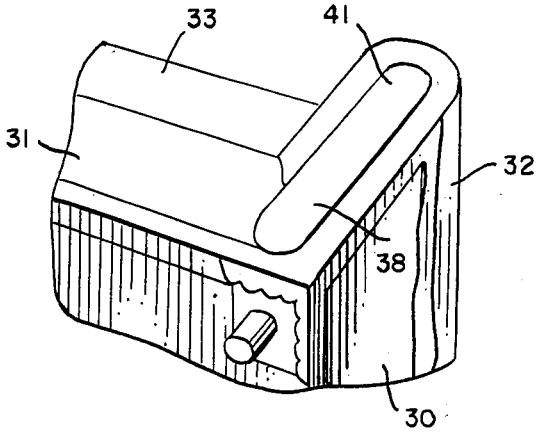
FIG. 4 shows the sofa with the finishing panel in place.

After tack strips or individual tacks are mounted on each of the edges 54 and 55 of the panel, the outside surface of the panel is covered by padding 58 and fabric 59. The edge 60 of the fabric is stapled to the undersurface of the panel by staples 61, and the other edges of the fabric can be simply pulled around the edges of the panel and secured to the undersurface. The fabric covers the portions of the tacks on the outside surface of the panel, and the tacks are therefore referred to as blind tacks. The completed panel can be attached to the furniture as shown in FIGS. 3 and 4.

The panel 56 can be formed from any suitable material. In one specific embodiment of the invention, the panel was formed from cardboard or fiberboard which was cut to the desired shape.

FIGS. 9–11 illustrate another embodiment of a blind tack 63. In FIG. 9 a flat metal base 64 is stamped with a V-shaped slit 65. The metal within the slit is punched out to form a pointed nail portion 66, and the base is bent transversely to form a generally U-shaped mounting portion 67 (FIG. 10).

A flat panel 68 (FIG. 12) is provided with openings 69. A pair of tacks 63 is mounted on the edge of each opening by inserting the U-shaped base of the tack over the edge of the opening. If desired, tacks may also be mounted along the outside edge of the panel. The panel can then be covered with fabric (with or without padding) as previously described.

FIGS. 13–15 illustrate still another form of tack 71. A flat piece of metal 72 (FIG. 13) is stamped to form a slit 73 having a V-shaped portion 74 and a straight portion 75. The V-shaped piece of metal is bent upwardly in the direction of the arrow A to form a tack portion 76, and the base is bent downwardly around the fold line 77 in the direction of the arrow B to form a U-shaped mounting portion 78 (FIG. 15). The top of the U-shaped mounting portion includes a stabilizing tab 79 which extends beyond the nail portion 76.

A panel 80 (FIGS. 16 and 17) is provided with slots 81 which extend inwardly from the outer edges of the panel. A tack 71 is mounted in each slot by inserting the U-shaped mounting portion of the tack over the edge of the slot so that the nail portion extends perpendicularly away from the undersurface of the panel.

Referring to FIGS. 18–20, a metal strip 82 is punched at successive stations of a metal forming machine to form a plurality of S-shaped slits 84 which will provide two pointed nail portions 85 and 86. The nail portions are then bent perpendicularly to the strip in opposite directions, and rectangular bases 87 are severed from the strip to form tacks 88.

These tacks 88 are secured to a panel 89 by pushing one of the nail portions through the surface 90 of the panel and then bending the nail portion over the other surface 91 of the panel to secure the base 87 against the panel. The surface 91 of the panel is then covered with fabric.

Figure 23:
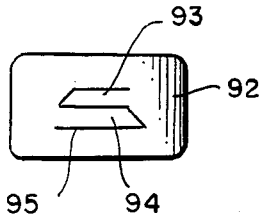
FIG. 23 is a plan view of a piece of metal for forming another tack.
Figure 24:
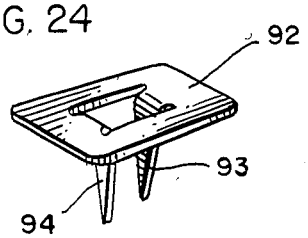
FIG. 24 is a perspective view of a completed tack.
Figure 25:
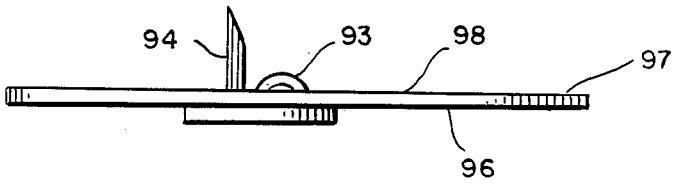
FIG. 25 is a side elevational view showing the tack of FIG. 24 mounted on a panel.
Figure 26:
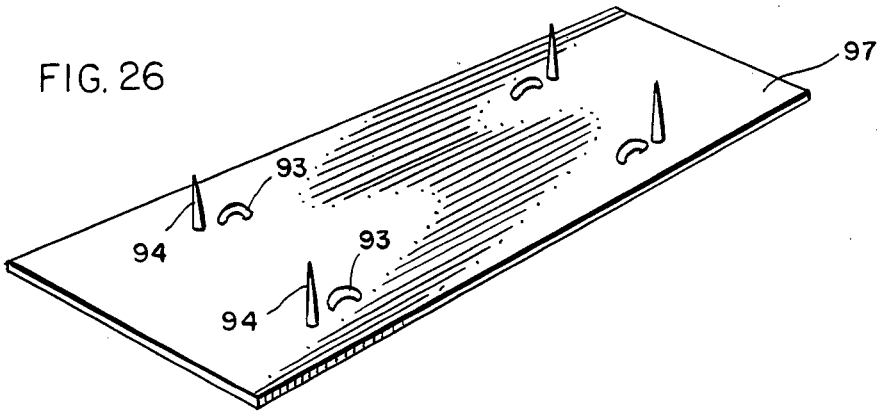
FIG. 26 is a perspective view showing a plurality of tacks of FIG. 24 mounted on a panel.

FIG. 23 illustrates a metal base 92 which may be punched in strip form like the strip 83 of FIG. 18. In this case the nail portions 93 and 94 which are formed by the S-shaped slit 95 are bent from the base in the same direction (FIG. 24). Both nail portions are pushed through the outer or other surface 96 of a panel 97, and one of the nail portions 93 is bent over the undersurface or one surface 98 to secure the tack on the panel. The outer surface 96 of the panel is then covered with fabric.

In FIGS. 5–17 the mounting portion of the tack is provided by a U-shaped base of the tack which is inserted over an edge portion of the panel. If the panel is provided with openings or slits, the tacks can even be mounted on the panel after the panel is mounted on the fabric. In FIGS. 18–26 the mounting portion is provided by the combination of a flat base which bears against a surface of the panel and one of the nail portions which bears against the opposite surface of the panel.

While in the foregoing specification a detailed description of specific embodiments of the invention was set forth for the purpose of illustration, it will be understood that many of the details hereingiven may be varied considerably by those skilled in the art without departing from the spirit and scope of the invention.

I claim:

1. A method of attaching finishing panels to upholstered furniture comprising the steps of:

drivably attaching a plurality of tacks to a panel having a pair of generally flat surfaces so that the tacks extend away from one of the surfaces;

subsequently covering the other surface of the panel with fabric; and nailing the tacks into a piece of upholstered furniture so that the fabric-covered surface of the panel faces outwardly from the furniture.

2. The method of claim 1 in which each of the tacks includes a base portion and a pair of pointed nail portions which extend from the base portion in the same direction, each tack being attached to the panel by inserting both of the nail portions through the panel and bending one of the nail portions over said one surface of the panel.

3. A method of attaching finishing panels to upholstered furniture comprising the steps of:

forming an elongated strip of metal so that a plurality of pointed nail portions extend from the strip;

severing the strip into discrete lengths to form individual tacks, each tack having a flat base portion and a pair of nail portions extending from the base portion;

drivably attaching a plurality of tacks to a panel having a pair of flat surfaces so that one of the nail portions of each tack extends away from one of the surfaces of the panel by inserting the other of said nail portions of each tack through the panel and bending said other nail portion over the panel;

subsequently covering the other surface of the panel with fabric; and nailing the tacks into a piece of upholstered furniture so that the fabric-covered surface of the panel faces outwardly from the furniture.

4. The method of claim 3 in which both nail portions are inserted through the panel from said other panel surface to said one panel surface so that one nail portion extends from said one panel surface, and bending said other nail portion over said one panel surface.

* * * * *